US010390397B1

(12) United States Patent
Chen

(10) Patent No.: US 10,390,397 B1
(45) Date of Patent: Aug. 20, 2019

(54) MICRO LIGHT-EMITTING DIODE DRIVING CIRCUIT AND DISPLAY USING THE SAME

(71) Applicant: MIKRO MESA TECHNOLOGY CO., LTD., Apia (WS)

(72) Inventor: Li-Yi Chen, Tainan (TW)

(73) Assignee: MIKRO MESA TECHNOOGY CO., LTD., Apia (WS)

( * ) Notice: Subject to any disclaimer, the term of this patent is extended or adjusted under 35 U.S.C. 154(b) by 0 days.

(21) Appl. No.: 16/243,101

(22) Filed: Jan. 9, 2019

(51) Int. Cl.
*H05B 33/00* (2006.01)
*H05B 33/08* (2006.01)

(52) U.S. Cl.
CPC ..... *H05B 33/0821* (2013.01)

(58) Field of Classification Search
CPC ..... H01L 27/3265; H01L 27/124; H01L 27/1255; H01L 27/32; H01L 27/3211; H01L 27/3216; H01L 27/3248; H01L 27/3276; H01L 27/3288; H01L 2224/16148; H01L 24/16; H01L 25/162; H01L 25/167; H01L 25/18; H01L 27/1214; H01L 27/156; H01L 2924/12041; H01L 2924/1426; H01L 27/1225; H01L 27/3262; H01L 27/3274; H01L 29/24; H01L 29/66969; H01L 29/7869; H01L 29/78696; H01L 51/5012; H04L 2001/125; H04L 2209/56; H04L 2209/80; H04L 5/0044; H04L 9/0822; H04L 9/0872
See application file for complete search history.

(56) References Cited

U.S. PATENT DOCUMENTS

2015/0371585 A1* 12/2015 Bower ..... G09G 3/32 345/1.1
2019/0164498 A1* 5/2019 Jang ..... G09G 3/3266

* cited by examiner

*Primary Examiner* — Monica C King
(74) *Attorney, Agent, or Firm* — CKC & Partners Co., LLC

(57) ABSTRACT

A micro light-emitting diode driving circuit is provided. First and second driving transistors respectively receive a first driving voltage and a second driving voltage, and are electrically connected to the micro light-emitting diode and a low voltage source. A length of an edge of a channel of the first driving transistor in contact with the source terminal is shorter than that in contact with the drain terminal. A length of an edge of a channel of the second driving transistor in contact with the source terminal is greater than or equal to that in contact with the drain terminal. One of the source and drain terminals of the first driving transistor and one of the source and drain terminals of the second driving transistor are electrically and separately connected to one end of the micro light-emitting diode.

17 Claims, 13 Drawing Sheets

MICRO LIGHT-EMITTING DIODE DRIVING CIRCUIT AND DISPLAY USING THE SAME

BACKGROUND

Field of Invention

The present disclosure relates to a micro light-emitting diode driving circuit which enables space saving for a circuit layout of a high dynamic range display.

Description of Related Art

The statements in this section merely provide background information related to the present disclosure and do not necessarily constitute prior art.

In recent years, micro devices have become popular in various applications. One of the promising subfield is micro light-emitting diode devices, and two of the important issues of said subfield are contrast of images or videos shown by a micro light-emitting diodes display and space utilization of a circuit layout.

SUMMARY

According to some embodiments of the present disclosure, a micro light-emitting diode driving circuit including a micro light-emitting diode, a first driving transistor, and a second driving transistor is provided. The first driving transistor is configured to receive a first driving voltage from a first driving voltage source, and is electrically connected to the micro light-emitting diode and a low voltage source. A length of an edge of a channel of the first driving transistor in contact with the source terminal is shorter than a length of an edge of a channel of the first driving transistor in contact with the drain terminal. The second driving transistor is configured to receive a second driving voltage from a second driving voltage source, and is electrically connected to the micro light-emitting diode and a low voltage source. A length of an edge of a channel of the second driving transistor in contact with the source terminal is greater than or equal to a length of an edge of a channel of the second driving transistor in contact with the drain terminal. One of the source and drain terminals of the first driving transistor and one of the source and drain terminals of the second driving transistor are electrically and separately connected to one end of the micro light-emitting diode, and a lateral length of the micro light-emitting diode is less than or equal to 50 μm.

According to some embodiments of the present disclosure, a micro light-emitting diode display including a substrate and a plurality of micro light-emitting diode driving circuits are provided. The plurality of micro light-emitting diode driving circuits are present on the substrate.

It is to be understood that both the foregoing general description and the following detailed description are by examples, and are intended to provide further explanation of the disclosure as claimed.

BRIEF DESCRIPTION OF THE DRAWINGS

The disclosure can be more fully understood by reading the following detailed description of the embodiment, with reference made to the accompanying drawings as follows.

DETAILED DESCRIPTION

Figure 1A:
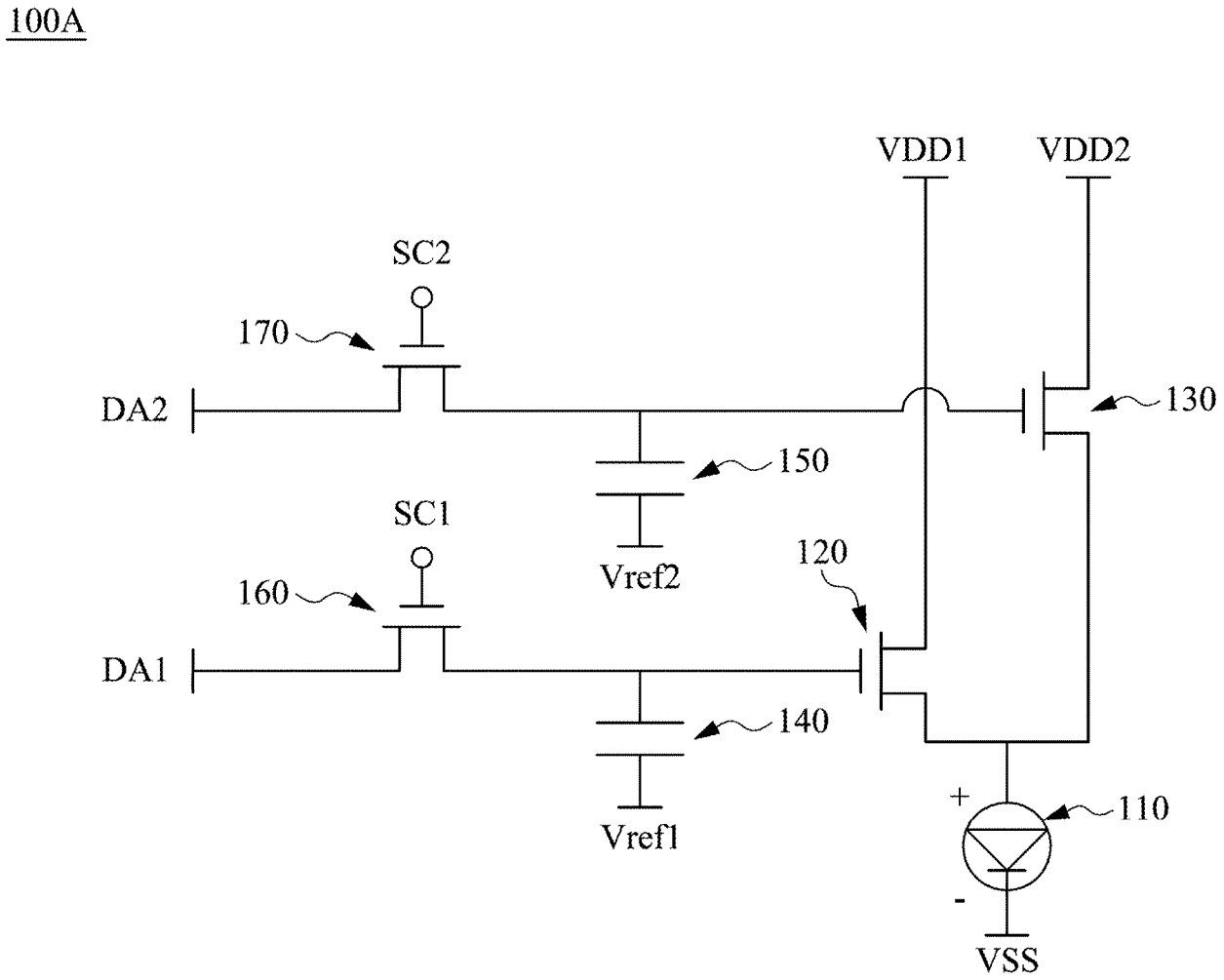
FIG. 1A is a schematic diagram of a micro light-emitting diode driving circuit in some embodiments of the present disclosure.

Reference will now be made in detail to the present embodiments of the disclosure, examples of which are illustrated in the accompanying drawings. Wherever possible, the same reference numbers are used in the drawings and the description to refer to the same or like parts.

In various embodiments, description is made with reference to figures. However, certain embodiments may be practiced without one or more of these specific details, or in combination with other known methods and configurations. In the following description, numerous specific details are set forth, such as specific configurations, dimensions and processes, etc., in order to provide a thorough understanding of the present disclosure. In other instances, well-known semiconductor processes and manufacturing techniques have not been described in particular detail in order to not unnecessarily obscure the present disclosure. Reference throughout this specification to "one embodiment," "an embodiment", "some embodiments" or the like means that a particular feature, structure, configuration, or characteristic described in connection with the embodiment is included in at least one embodiment of the disclosure. Thus, the appearances of the phrase "in one embodiment," "in an embodiment", "in some embodiments" or the like in various places throughout this specification are not necessarily referring to the same embodiment of the disclosure. Furthermore, the particular features, structures, configurations, or characteristics may be combined in any suitable manner in one or more embodiments.

The terms "over," "to," "between" and "on" as used herein may refer to a relative position of one layer with respect to other layers. One layer "over" or "on" another layer or bonded "to" another layer may be directly in contact with the other layer or may have one or more intervening layers. One layer "between" layers may be directly in contact with the layers or may have one or more intervening layers.

Although most of terms described in the following disclosure use singular nouns, said terms may also be plural in accordance with figures or practical applications.

Reference is made to FIG. 1A. FIG. 1A is a schematic diagram of a micro light-emitting diode driving circuit 100A in some embodiments of the present disclosure. In some embodiments, the micro light-emitting diode driving circuit 100A includes a micro light-emitting diode 110, a first driving transistor 120, and a second driving transistor 130. Each of the first driving transistor 120 and the second driving transistor 130 has a gate terminal, a drain terminal, and a source terminal. The micro light-emitting diode 110 has an anode and a cathode. The first driving transistor 120 receives a first driving voltage from a first driving voltage source VDD1. The first driving transistor 120 is electrically connected to the micro light-emitting diode 110. The first driving transistor 120 is electrically connected to a low voltage source VSS. The second driving transistor 130 receives a second driving voltage from a second driving voltage source VDD2. The second driving transistor 130 is electrically connected to the micro light-emitting diode 110 and the low voltage source VSS. In addition, one terminal (e.g., the source terminal or the drain terminal) of the first driving transistor 120 and one terminal (e.g., the source terminal or the drain terminal) of the second driving transistor 130 are electrically and separately connected to one end of the micro light-emitting diode. In other words, the first driving transistor 120 and the second driving transistor 130 are electrically arranged in parallel to each other with respect to one end (e.g, the anode or the cathode) of the micro light-emitting diode 110. A lateral length of the micro light-emitting diode 110 is less than or equal to 50 μm. It is important to note that the first driving transistor 120 is not connected to the micro light-emitting diode 110 via the second driving transistor 130, nor is the second driving transistor 130 connected to the micro light-emitting diode 110 via the first driving transistor 120. That is, the first driving transistor 120 is connected to the micro light-emitting diode 110 directly or via another element that is different from the second driving transistor 130, and the second driving transistor 130 is connected to the micro light-emitting diode 110 directly or via another element that is different from the first driving transistor 120. With the above configuration, a high dynamic range display can be realized. Specifically, for a relatively dark image or a portion of relatively dark pixels, one can turn on only the first driving transistor 120 to drive the micro light-emitting diode 110. For a relatively bright images or a portion of relatively bright pixels, one can turn on both the first driving transistor 120 and the second driving transistor 130 to drive the micro light-emitting diode 110. Each of the pixels described herein is assumed to have the same micro light-emitting diode driving circuit (e.g., identical to the micro light-emitting diode driving circuit 100A), but should not be limited thereto in practical applications. It should be noted that, although the embodiments in the present disclosure only demonstrate two driving transistors, a number of driving transistors more than two shall not depart from the scope of the present disclosure. For example, there may be three driving transistors, and each of the three driving transistors has one terminal (e.g., the source terminal or the drain terminal) electrically and separately connected to one end of the micro light-emitting diode 110. In other words, these three driving transistors are electrically arranged in parallel to each other with respect to one end (e.g., the anode or the cathode) of the micro light-emitting diode 110 to drive the micro light-emitting diode 110, so that three currents respectively flowing through the three driving transistors can converge and flow through the micro light-emitting diode 110.

In some embodiments as illustrated by FIG. 1A, the drain terminals of the first driving transistor 120 and the second driving transistor 130 are respectively connected to the first driving voltage source VDD1 and the second driving voltage source VDD2. The source terminals of the first driving transistor 120 and the second driving transistor 130 are connected to the anode of the micro light-emitting diode 110. The cathode of the micro light-emitting diode 110 is connected to the low voltage source VSS. The low voltage source VSS can be grounded, but should not limited thereto.

Figure 1B:
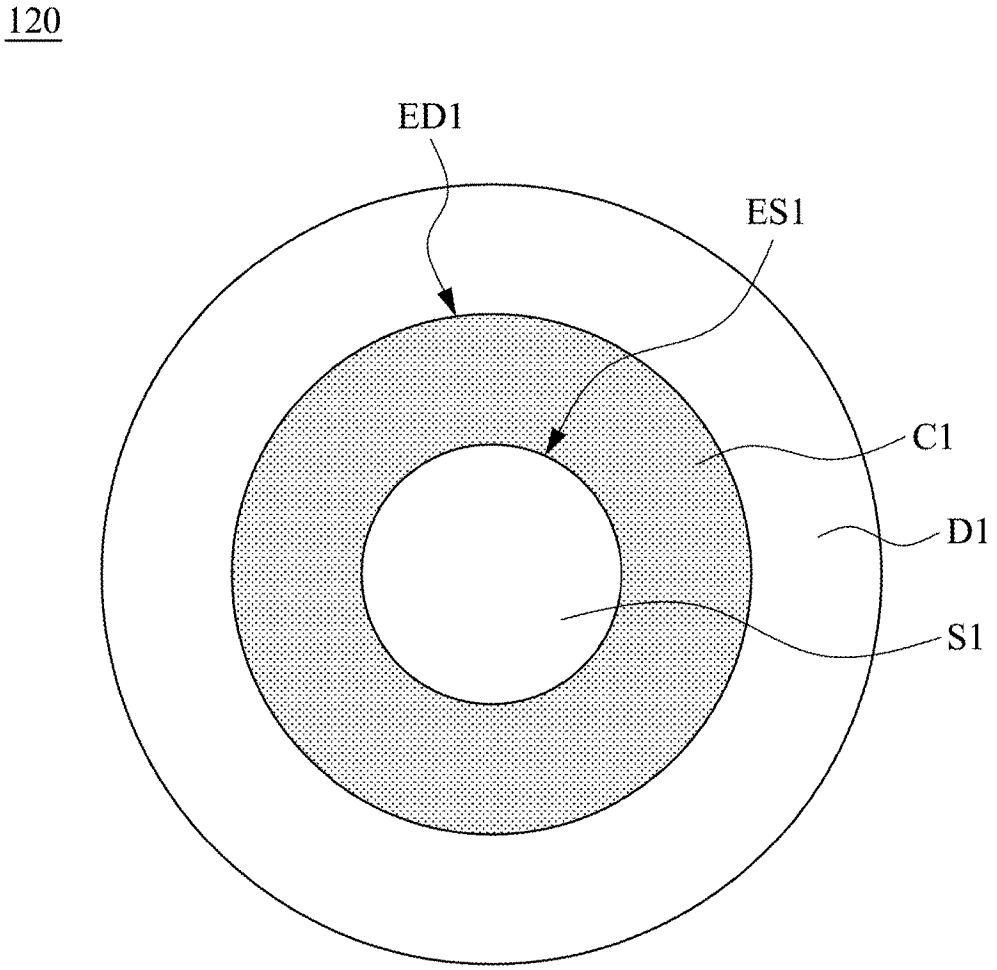
FIG. 1B is a schematic top view of a first driving transistor according to some embodiments of the present disclosure.

Reference is made to FIG. 1B. FIG. 1B is a schematic top view of a first driving transistor 120 according to some embodiments of the present disclosure. In some embodiments, a length of an edge ES1 of a channel C1 of the first driving transistor 120 in contact with the source terminal S1 is shorter than a length of an edge ED1 of a channel C1 of the first driving transistor 120 in contact with the drain terminal D1. This configuration can be realized by arranging the drain terminal D1 of the first driving transistor 120 to surround the source terminal S1 of the first driving transistor 120. Specifically, in some embodiments, the first driving transistor 120 complying with the aforementioned configuration may have a circular shape, in which the source terminal S1 is enclosed by the channel C1 (e.g., a semiconductor layer), and the channel C1 is enclosed by the drain terminal D1, as shown in FIG. 1B. In other embodiments, the first driving transistor 120 complying with the aforementioned configuration may also have an octagonal shape.

Figure 1C:
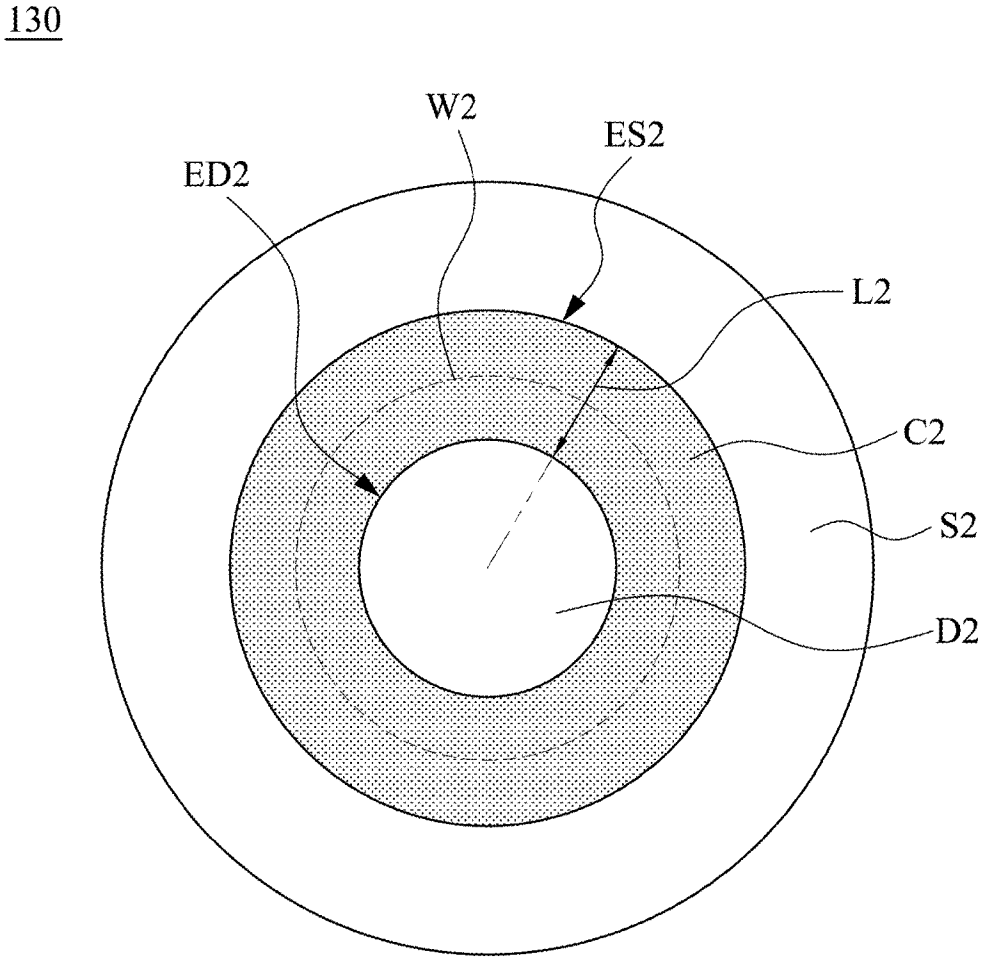
FIG. 1C is a schematic top view of a second driving transistor according to some embodiments of the present disclosure.

Reference is made to FIG. 1C. FIG. 1C is a schematic top view of a second driving transistor 130 according to some embodiments of the present disclosure. In some embodiments, a length of an edge ES2 of a channel C2 of the second driving transistor 130 in contact with the source terminal S2 is greater than a length of an edge ED2 of a channel C2 of the second driving transistor 130 in contact with the drain terminal D2. This configuration can be realized by arranging the source terminal S2 of the second driving transistor 130 to surround the drain terminal D2 of the second driving transistor 130. Specifically, in some embodiments, the second driving transistor 130 complying with the aforementioned configuration may have a circular shape, in which the drain terminal D2 is enclosed by the channel C2 (e.g., a semiconductor layer), and the channel C2 is enclosed by the source terminal S2, as shown in FIG. 1C.

Under the circumstances that the same gate voltage is applied to the first driving transistor 120 and the second driving transistor 130 and that the first driving transistor 120 and the second driving transistor 130 have the same width-to-length ratio, the second driving transistor 130 illustrated by FIG. 1C has a greater current flowing through the second driving transistor 130 compared to that of the first driving transistor 120 illustrated by FIG. 1B. However, since a current density of the current flowing through the channel C1 of the first driving transistor 120 illustrated by FIG. 1B is smaller, a stress is also less, so that the first driving transistor 120 is more unlikely to create defects within the channel C1 compared to defects created within the channel C2 of the second driving 130 transistor illustrated by FIG. 1C. Furthermore, since it is known that the first driving transistor 120 illustrated by FIG. 1B has a pinch-off point which is at lower applied drain-to-source voltage compared to a pinch-off point of the second driving transistor 130 as illustrated by FIG. 1C, the first driving transistor 120 is more likely to be operated in a saturation region. As a result, embodiments of the present disclosure not only can realize a high dynamic range display, but also can save a space in a pixel while complying with the aforementioned configurations of the first driving transistor 120 and the second driving transistor 130. The space is saved because a high current transistor and a low current transistor can be achieved using transistors with the same size. The only difference between the first driving transistor 120 and the second driving transistor 130 is that the relative position of the source terminal S1 and the drain terminal D1 of the first driving transistor 120 is just respectively opposite to the relative position of the source terminal S2 and the drain terminal D2 of the second driving transistor 130. There is no need to use a transistor with larger size to achieve a higher current.

Reference is made back to FIG. 1A. In some embodiments, the micro light-emitting diode driving circuits 100A may further include a first storage capacitor 140 and a second storage capacitor 150. Each of the first storage capacitor 140 and the second storage capacitor 150 has two ends. One of the two ends of the first storage capacitor 140 is connected to the gate terminal of the first driving transistor 120. The other end of the first storage capacitor 140 is connected to a first reference voltage Vref1. One of the two ends of the second storage capacitor 150 is connected to the gate terminal of the second driving transistor 130. The other end of the second storage capacitor 150 is connected to a second reference voltage Vref2. The storage capacitors 140, 150 are used to keep voltages of the gate terminals of the driving transistors 120, 130 respectively until next voltages (e.g., next frame) are applied. In some embodiments, said the other end of the first storage capacitor 140 can also be connected to the source terminal S1 of the first driving transistor 120. In some embodiments, said the other end of the second storage capacitor 150 can also be connected to the source terminal S2 of the second driving transistor 130.

In some embodiments, the micro light-emitting diode driving circuits 100A may further include a first switching transistor 160 and a second switching transistor 170. The first switching transistor 160 has a gate terminal, a drain terminal, and a source terminal. The gate terminal of the first switching transistor 160 is connected to a first scan line SC1. The drain terminal of the first switching transistor 160 is connected to a first data line DA1. The source terminal of the first switching transistor 160 is connected to the gate terminal of the first driving transistor 120 and one end of the first storage capacitor 140, in which said end is also connected to the gate terminal of the first driving transistor 120. The second switching transistor 170 has a gate terminal, a drain terminal, and a source terminal. The gate terminal of the second switching transistor 170 is connected to a second scan line SC2. The drain terminal of the second switching transistor 170 is connected to a second data line DA2. The source terminal of the second switching transistor 170 is connected to the gate terminal of the second driving transistor 130 and one end of the second storage capacitor 150, in which said end is also connected to the gate terminal of the second driving transistor 130. The scan lines SC1, SC2 control a renewal of an image. The data lines DA1, DA2 respectively determine a gate voltage of the first driving transistor 120 and a gate voltage of the second driving transistor 130. Furthermore, a combination of the first data line DA1 and the first driving voltage source VDD1, and a combination of the second data line DA2 and the second driving voltage source VDD2 jointly determine a brightness of the micro light-emitting diode 110. The switching transistors 160, 170 are used as switches respectively to determine if the driving transistors 120, 130 are allowed to apply currents for the micro light-emitting diode 110.

Figure 2:
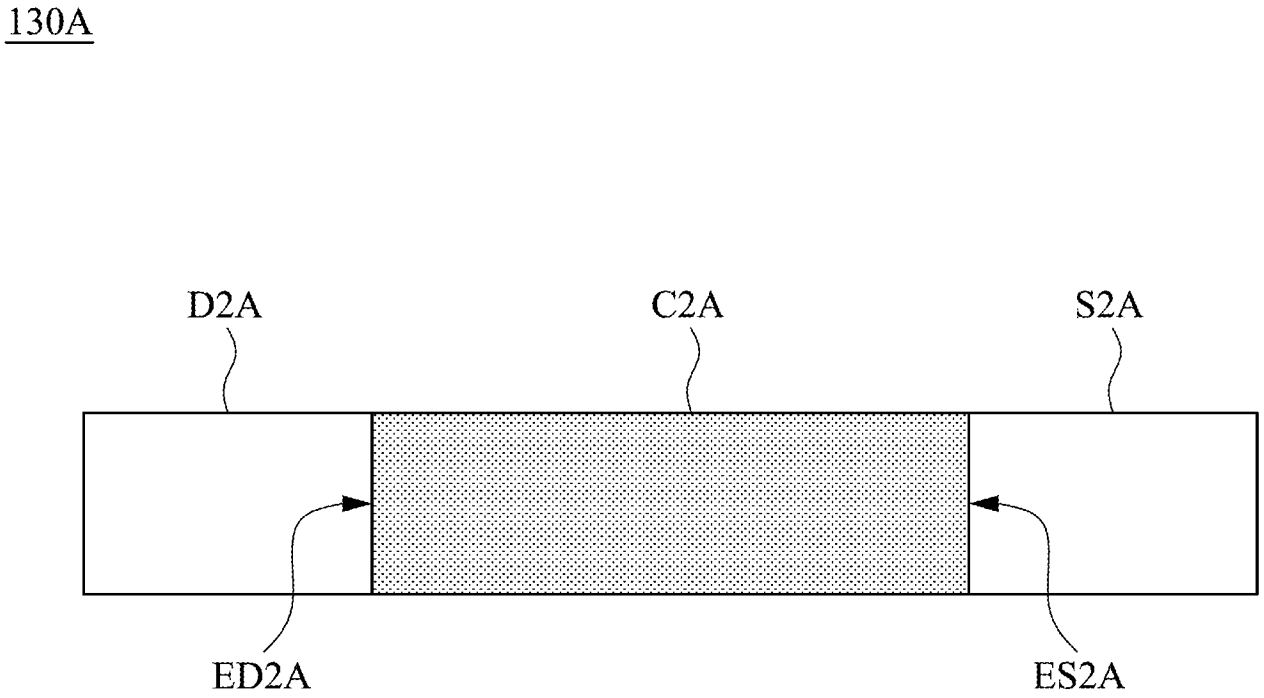
FIG. 2 is a schematic top view of a second driving transistor according to some embodiments of the present disclosure.

Reference is made to FIG. 2. FIG. 2 is a schematic top view of a second driving transistor 130A according to some embodiments of the present disclosure. In some embodiments, a length of an edge ES2A of a channel C2A of the second driving transistor 130A in contact with the source terminal S2A is equal to a length of an edge ED2A of the channel C2A of the second driving transistor 130A in contact with the drain terminal D2A. This kind of the second driving transistor 130A can have a stripe type channel (e.g., the channel C2A), but should not be limited thereto. That is, an edge ES2A of the channel C2A of the second driving transistor 130A in contact with the source terminal S2A and an edge ED2A of the channel C2A of the second driving transistor 130A in contact with the drain terminal D2A are stripes and parallel to one another. This configuration, together with the first transistor 120 as illustrated by FIG. 1B, can also realize said high dynamic range display and achieve the purpose of saving the space.

Figure 3:
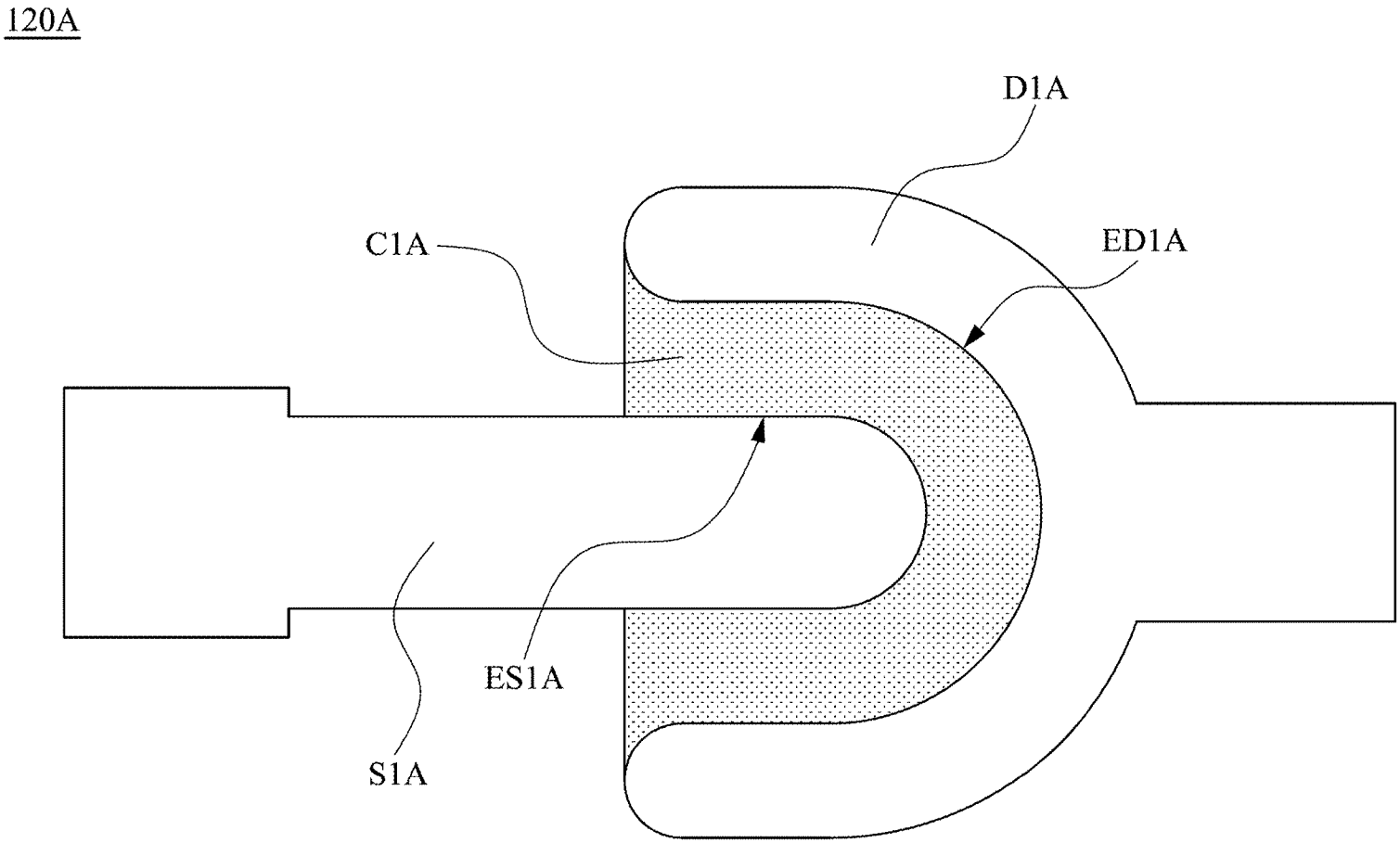
FIG. 3 is a schematic top view of a first driving transistor according to some embodiments of the present disclosure.

Reference is made to FIG. 3. FIG. 3 is a schematic top view of a first driving transistor 120A according to some embodiments of the present disclosure. In some embodiments, a source terminal S1A is surrounded but not fully enclosed by a channel C1A. Specifically, the channel C1A and the drain terminal D1A are U-shaped. An inner U-shaped edge ES1A of the channel C1A is in contact with the source terminal S1A. The outer U-shaped edge ED1A of the channel C1A is in contact with the drain terminal D1A. Sides on two ends of the U-shaped channel C1A are not in contact with the source terminal S1A and the drain terminal D1A. As such, a length of the inner U-shaped edge ES1A of the channel C1A of the first driving transistor 120A in contact with the source terminal S1A is shorter than a length of the outer U-shaped edge ED1A of the channel C1A of the first driving transistor 120A in contact with the drain terminal D1A.

Figure 4:
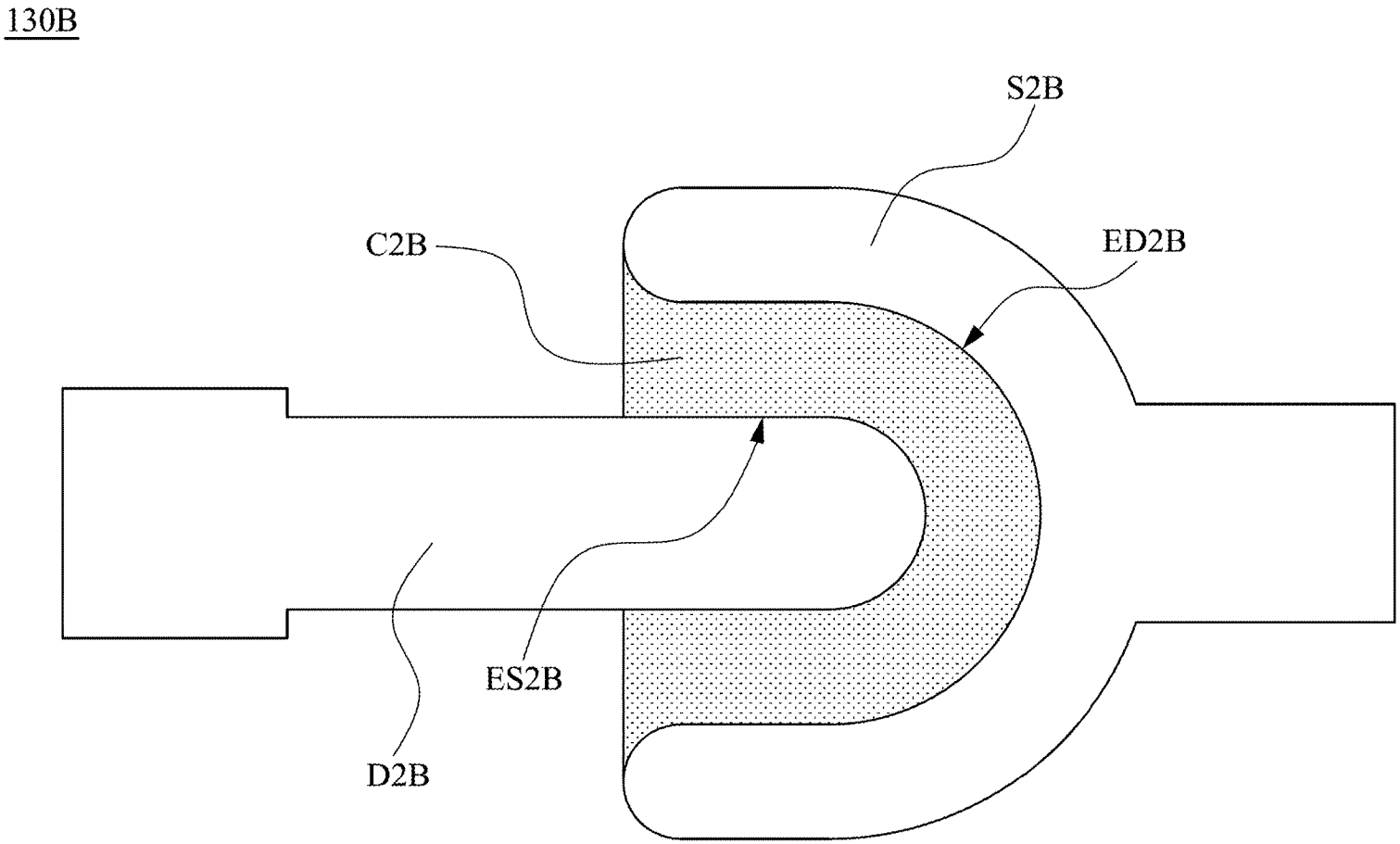
FIG. 4 is a schematic top view of a second driving transistor according to some embodiments of the present disclosure.

Reference is made to FIG. 4. FIG. 4 is a schematic top view of a second driving transistor 130B according to some embodiments of the present disclosure. In some embodiments, a drain terminal D2B is surrounded but not fully enclosed by a channel C2B. Specifically, the channel C2B and the source terminal S2B are U-shaped. An inner U-shaped edge ES2B of the channel C2B is in contact with the drain terminal D2B. The outer U-shaped edge ED2B of the channel C2B is in contact with the source terminal S2B. Sides on two ends of the U-shaped channel C2B are not in contact with the source terminal S2B and the drain terminal D2B. As such, a length of the inner U-shaped edge ES2B of the channel C2B of the second driving transistor 130B in contact with the drain terminal D2B is shorter than a length of the outer U-shaped edge ED2B of the channel C2B of the second driving transistor 120A in contact with the source terminal S2B.

As a short conclusion, some embodiments of the present disclosure show that with a first driving transistor designed to be an outer-drain-inner-source configuration and a second driving transistor designed to be an outer-source-inner-drain configuration (e.g., the second driving transistors 130, 130B) or a conventional stripe type configuration (e.g., the channel C2A of the second driving transistor 130A), advantages of the high dynamic range display and saving the space of the pixel can be simultaneously realized.

It should be noted that, FIGS. 1B, 1C, 2, 3, and 4 do not show all elements of a driving transistor, and the main purpose of FIGS. 1B, 1C, 2, 3, and 4 is to show a geometric relationship of contacts between a source and a channel or between a drain and a channel. Therefore, some elements, such as a gate terminal, an oxide layer, or electrodes connecting the source/drain to other circuit elements are omitted, so that features of said contacts to be revealed in FIGS. 1B, 1C, 2, 3, and 4 are more clear.

Figure 5:
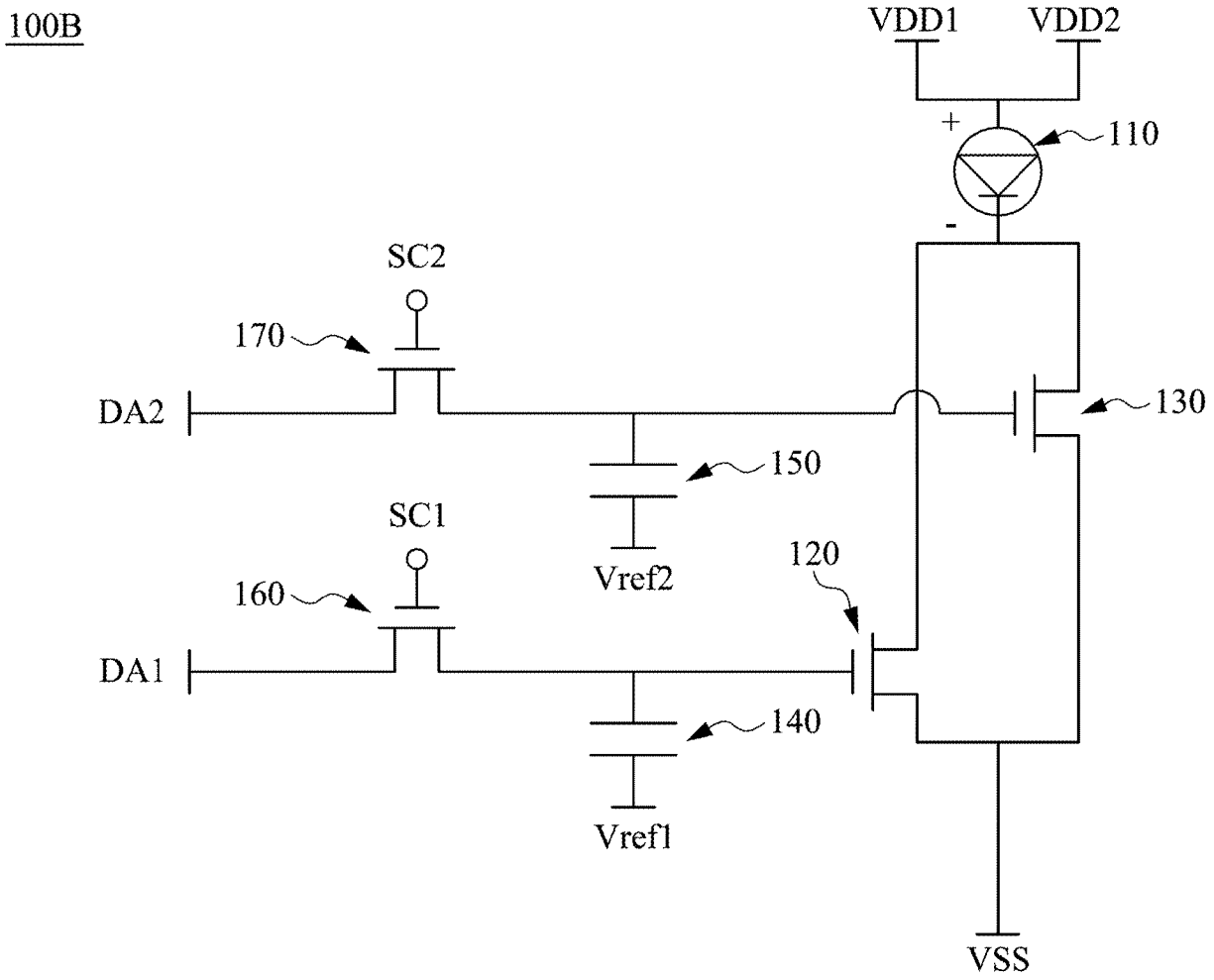
FIG. 5 is a schematic diagram of a micro light-emitting diode driving circuit in some embodiments of the present disclosure.

Reference is made to FIG. 5. FIG. 5 is a schematic diagram of a micro light-emitting diode driving circuit 100B in some embodiments of the present disclosure. In some embodiments as illustrated by FIG. 5 and with reference also to FIGS. 1B and 1C, the drain terminals D1, D2 of the first driving transistor 120 and the second driving transistor 130 are connected to the cathode of the micro light-emitting diode 110. The source terminals S1, S2 of the first driving transistor 120 and the second driving transistor 130 are connected to the low voltage source VSS. The anode of the micro light-emitting diode 110 is connected to the first driving voltage source VDD1 and the second driving voltage source VDD2.

Figure 6:
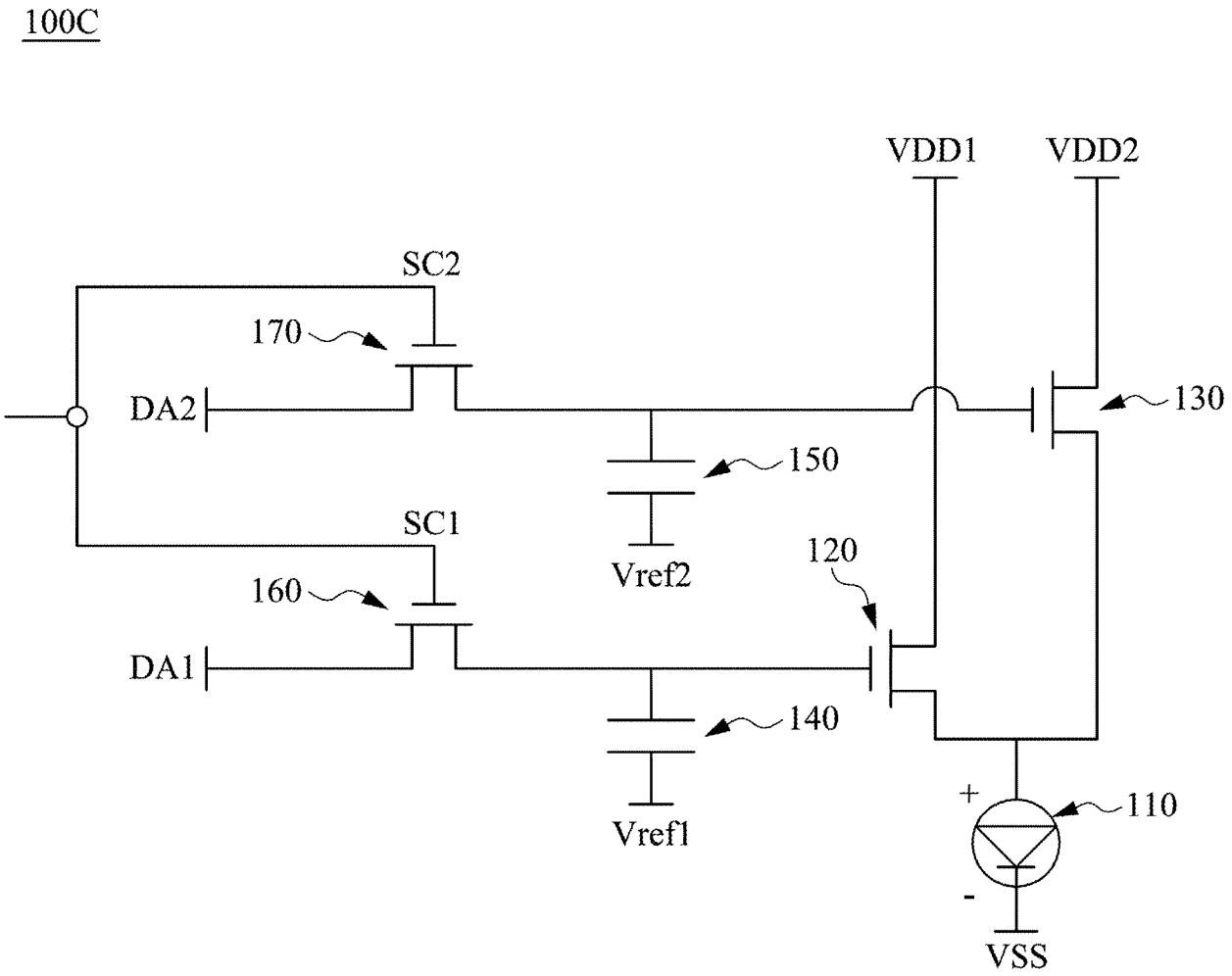
FIG. 6 is a schematic diagram of a micro light-emitting diode driving circuit in some embodiments of the present disclosure.

Reference is made to FIG. 6. FIG. 6 is a schematic diagram of a micro light-emitting diode driving circuit 100C in some embodiments of the present disclosure. The micro light-emitting diode driving circuit 100C is similar to the micro light-emitting diode driving circuit 100A, except that the first scan line SC1 and the second scan line SC2 are connected to a junction in the embodiments illustrated by FIG. 6, while the first scan line SC1 and the second scan line SC2 are separated from each other in the embodiments illustrated by FIG. 1A. Therefore, the first scan line SC1 and the second scan line SC2 can be the same scan line, so as to simplify a circuit layout.

Figure 7:
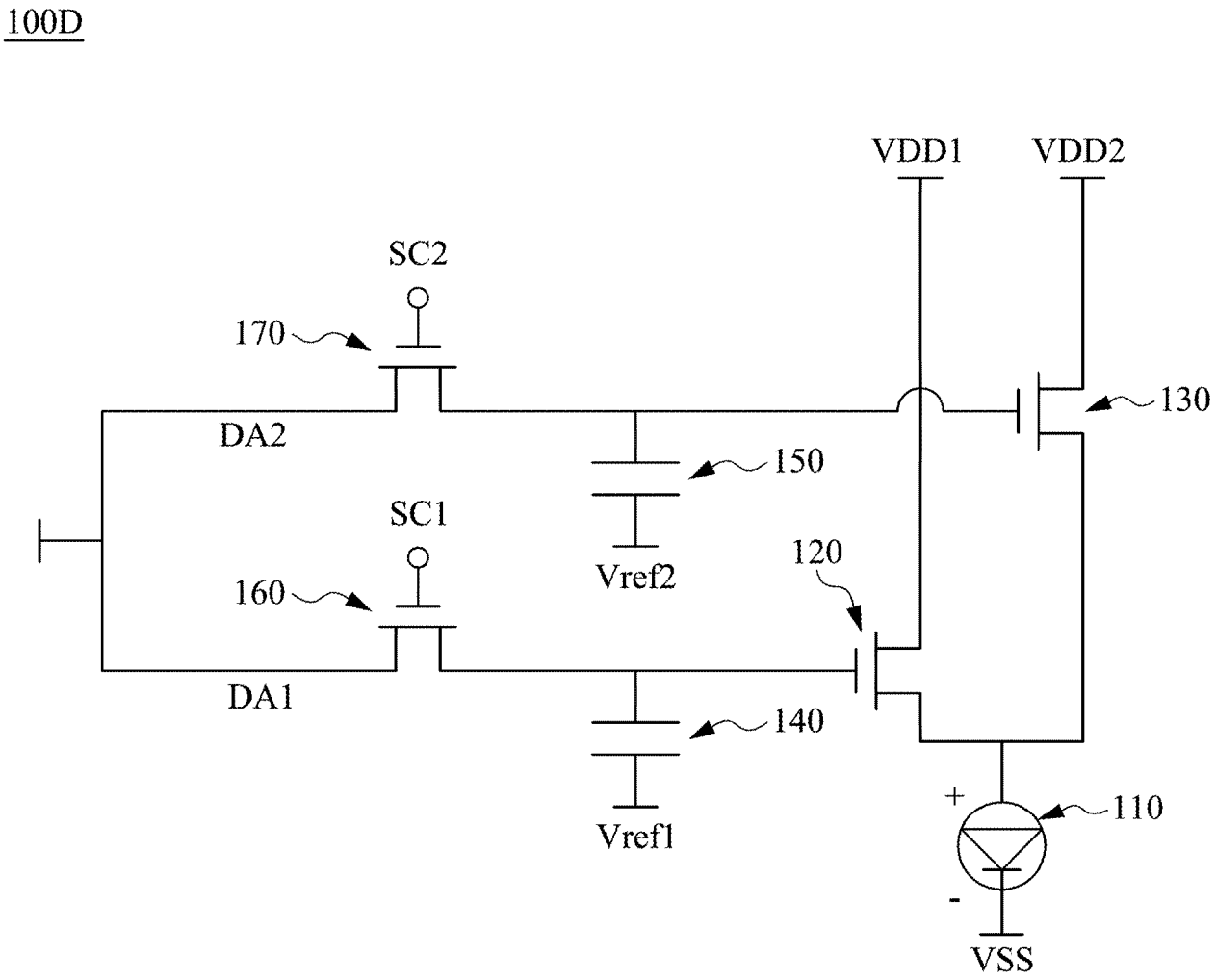
FIG. 7 is a schematic diagram of a micro light-emitting diode driving circuit in some embodiments of the present disclosure.

Reference is made to FIG. 7. FIG. 7 is a schematic diagram of a micro light-emitting diode driving circuit 100D in some embodiments of the present disclosure. The micro light-emitting diode driving circuit 100D is similar to the micro light-emitting diode driving circuit 100A, except that the first data line DA1 and the second data line DA2 are connected to a junction in the embodiments illustrated by FIG. 7, while the first data line DA1 and the second data line DA2 are separated from each other in the embodiments illustrated by FIG. 1A. Therefore, the first data line DA1 and the second data line DA2 can be the same data line, so as to simplify a circuit layout.

Figure 8:
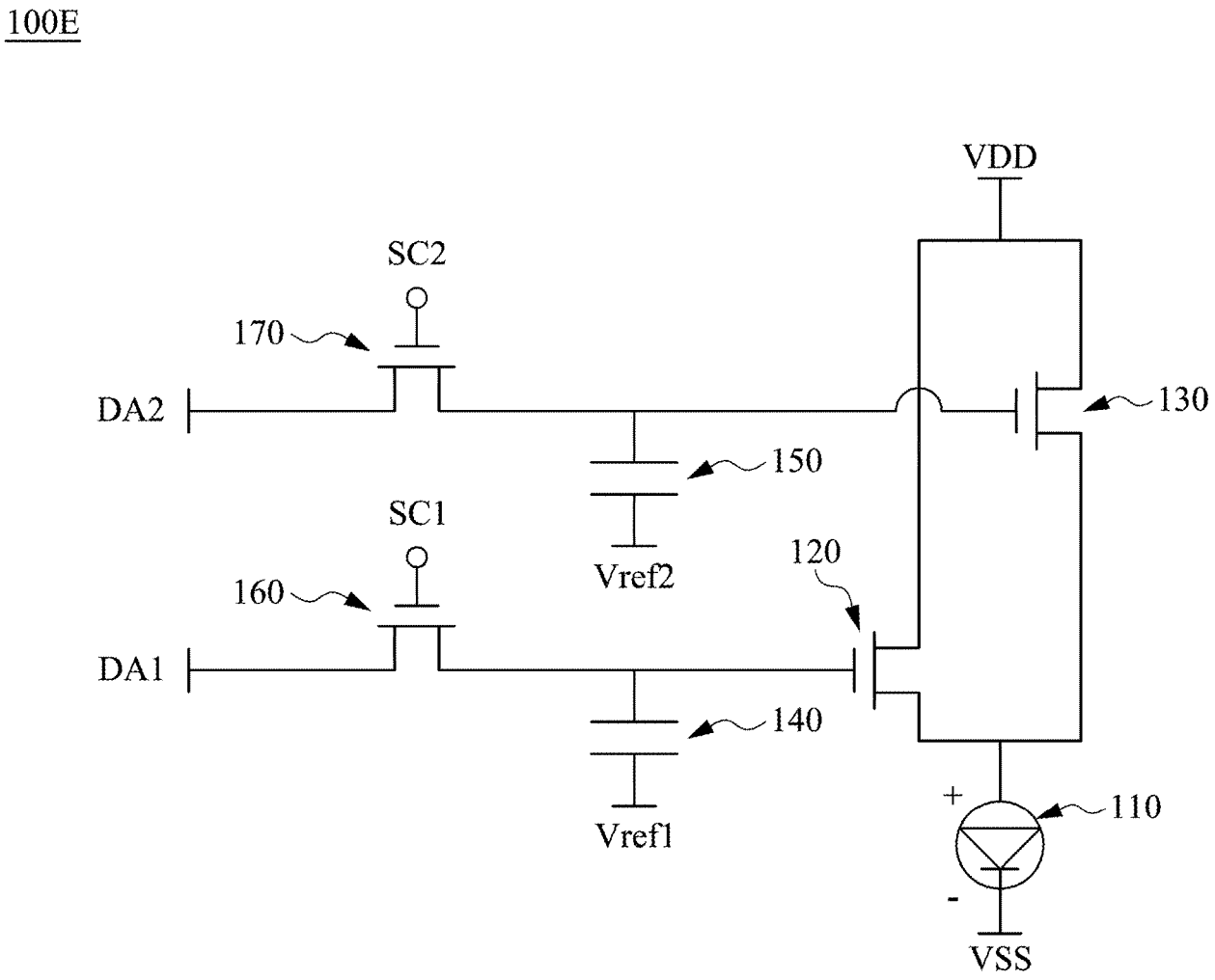
FIG. 8 is a schematic diagram of a micro light-emitting diode driving circuit in some embodiments of the present disclosure.

Reference is made to FIG. 8. FIG. 8 is a schematic diagram of a micro light-emitting diode driving circuit 100E in some embodiments of the present disclosure. The micro light-emitting diode driving circuit 100E is similar to the micro light-emitting diode driving circuit 100A, except that a common driving voltage source VDD is used in the embodiments illustrated by FIG. 8 (i.e. the first driving voltage source VDD1 and the second driving voltage source VDD2 in FIG. 1A become the same driving voltage source), while the first driving voltage source VDD1 and the second driving voltage source VDD2 are separated from each other in the embodiments illustrated by FIG. 1A. Therefore, the first driving voltage source VDD1 and the second driving voltage source VDD2 can be the same driving voltage source, so as to simplify a circuit layout.

Figure 9A:
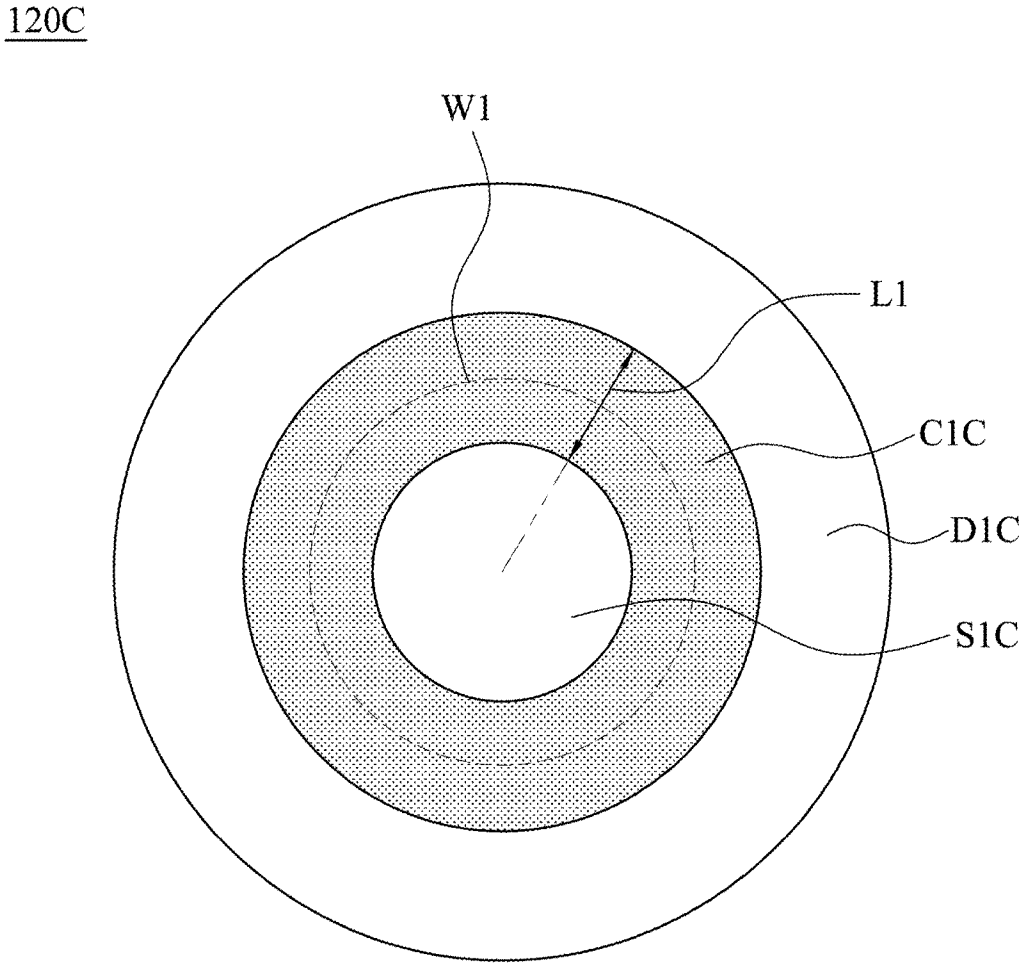
FIG. 9A is a schematic top view of a first driving transistor according to some embodiments of the present disclosure.
Figure 9B:
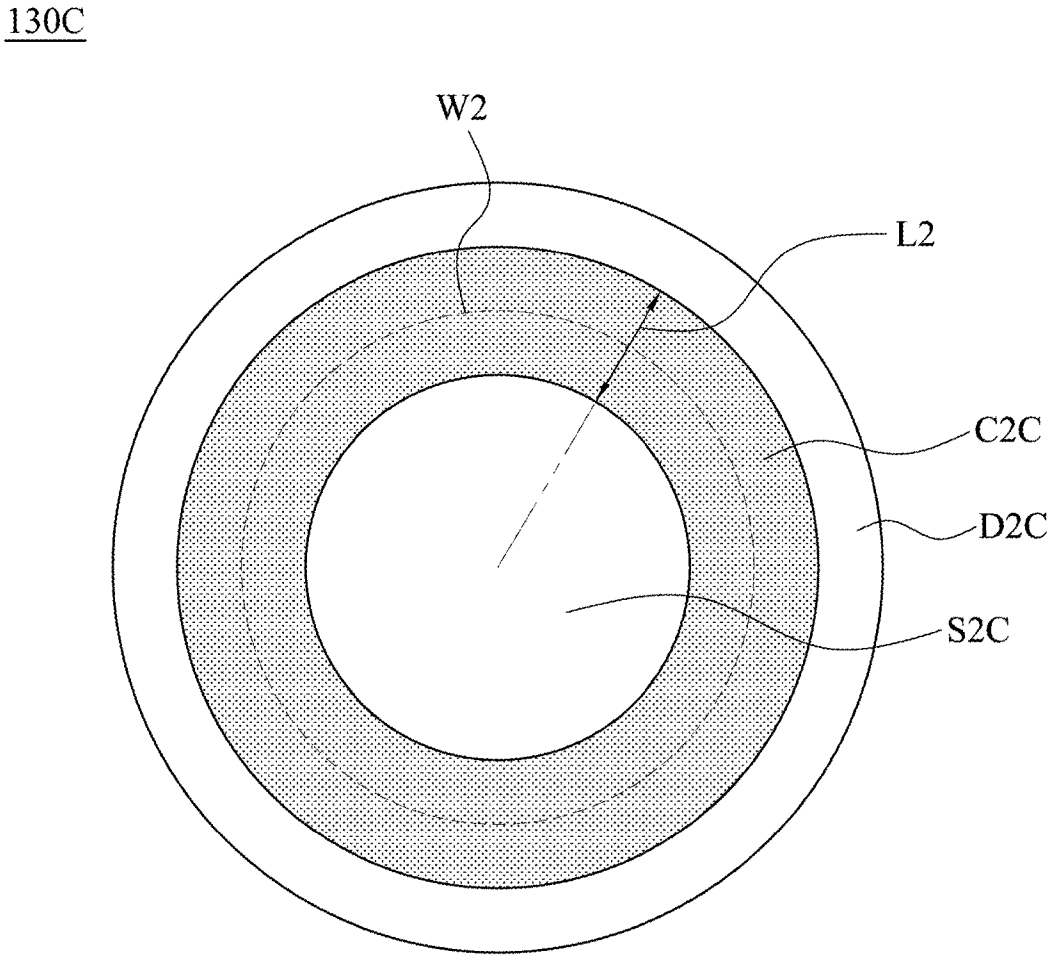
FIG. 9B is a schematic top view of a second driving transistor according to some embodiments of the present disclosure.

Reference is made to FIGS. 9A, 9B, and 1A. FIG. 9A is a schematic top view of the first driving transistor 120C according to some embodiments of the present disclosure. FIG. 9B is a schematic top view of the second driving transistor 130C according to some embodiments of the present disclosure. In some embodiments, a ratio of a channel width W2 to a channel length L2 of the second driving transistor 130C is greater than a ratio of a channel width W1 to a channel length L1 of the first driving transistor 120C. A source S1C, a drain D1C, and a channel C1C (e.g., a semiconductor layer) of the first driving transistor 120C and a source S2C, a drain D2C, and a channel C2C (e.g., a semiconductor layer) of the second driving transistor 130C are schematically shown in FIGS. 9A and 9B respectively. Since a higher width-to-length ratio of a channel can increase a current gain and subsequently has a higher current for a given gate voltage, the second driving transistor 130C can be a transistor which is normally off and is particularly used in a case with an extremely high contrast or high brightness, such as an image with localized sunshine. In such high brightness pixels, the first driving transistor 120C can be off or on. Therefore, a high dynamic range display can be realized while a lifetime of driving transistors 120C, 130C can be maintained. The lifetime of the first driving transistor 120C can be longer since there is no need to apply high gate voltages to the first driving transistor 120C in the above parallel arrangement (i.e., currents flowing through the driving transistors are converged and flow through the micro light-emitting diode 110), so as to prevent lifetime shortening on the first driving transistor 120C. In some embodiments, said ratio of the channel width W2 to the channel length L2 of the second driving transistor 130C is at least twice greater than said ratio of the channel width W1 to the channel length L1 of the first driving transistor 120C.

In some embodiments, a ratio of a channel width W2 to a channel length L2 of the second driving transistor 130C is the same as a ratio of a channel width W1 to a channel length L1 of the first driving transistor 120C. In these embodiments, the dynamic range can also be high due to two parallel transistors as current sources for the micro light-emitting diode 110. Either one of the first driving transistor 120C and the second driving transistor 130C is on, or both of the first driving transistor 120C and the second driving transistor 130C are on.

As a further explanation and a comparison, a conventional thin film transistor liquid crystal display (TFT-LCD) has a maximum brightness about 500 nits. However, it is not enough for a case such as an image having a sunrise therein, which needs locally 3000 nits or even 10000 nits. With the first driving transistor 120C shown in FIG. 9A and the second driving transistor 130C shown in FIG. 9B electrically arranged in parallel to each other with respect to the micro light-emitting diode 110, currents respectively flowing through the first driving transistor 120C and the second driving transistor 130C are converged to flow through the micro light-emitting diode 110. With the micro light-emitting diode 110 having a lateral length less than or equal to 50 μm, the above insufficiency of the conventional TFT-LCD can be solved. The use of the micro light-emitting diode 110 is important since a range of currents it can bear is larger than other light emitting elements, (e.g., organic light-emitting diode), so that it can have a high dynamic range of illumination with the help of said parallel arrangement of the driving transistors. It should be noted that, the first driving transistor 120C and the second driving transistor 130C having circular shapes as shown in FIGS. 9A and 9B are just exemplifications. Other combinations, such as the first driving transistor 120C having a circular shape and the second driving transistor 130C having a stripe type channel are also within the scope of the present disclosure. The dotted line indicating the channel widths W1 and W2 in FIGS. 9A and 9B are just a schematic indication and does not necessarily represent the real reference for calculating the channel widths W1 and W2. The calculation of the channel widths W1 and W2 will not be described in details in the present disclosure.

Figure 10:
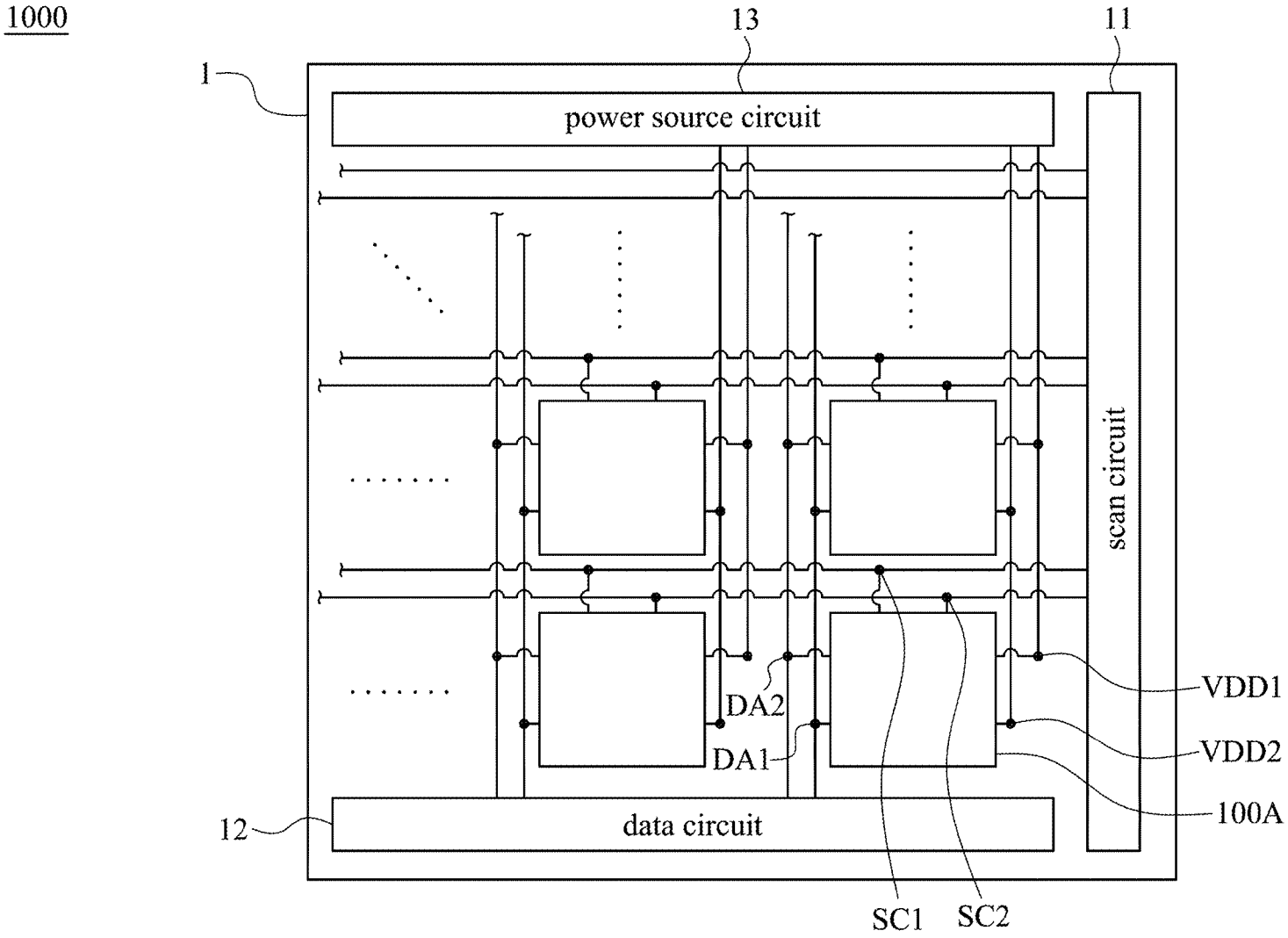
FIG. 10 is a schematic top view of a micro light-emitting diode display according to some embodiments of the present disclosure.

Reference is made to FIG. 10 and FIGS. 1A and 5-8. FIG. 10 is a schematic top view of a micro light-emitting diode display 1000 according to some embodiments of the present disclosure. In some embodiments, the micro light-emitting display 1000 includes a substrate 1 and a plurality of micro light-emitting diode driving circuits. Although FIG. 10 only indicates the micro light-emitting diode driving circuit 100A, it is only for an exemplification. Other kinds of micro light-emitting diode driving circuits (e.g., the micro light-emitting diode driving circuits 100B, 100C, 100D, 100E, a combination thereof, or the like) can be present in embodiments as illustrated by FIG. 10, and should not be limited thereto. Each of blocks in FIG. 10 represents a micro light-emitting diode driving circuit, or equivalently, one pixel. The micro light-emitting diode driving circuits are present on the substrate 1. The micro light-emitting diode display 1000 can further include a scan circuit 11, a data circuit 12, and a driving voltage source circuit 13. The scan circuit 11 is configured to provide scan voltages to scan lines (e.g., the scan line SC1 and the scan line SC2 of the micro light-emitting diode driving circuit 100A, but should not be limited thereto). The data circuit 12 is configured to provide data voltages to data lines (e.g., the data line DA1 and the data line DA2 of the micro light-emitting diode driving circuit 100A, but should not be limited thereto). The power source circuit 13 acts as driving voltage sources to provide driving voltages to the micro light-emitting diode driving circuits. For example, the power source circuit 13 can act as the first driving voltage source VDD1 to provide the first driving voltage to the first driving transistor 120 of the micro light-emitting diode driving circuit 100A, and also act as the second driving voltage source VDD2 to provide the second driving voltage to the second driving transistor 130 of the micro light-emitting diode driving circuit 100A.

In summary, a parallel arrangement of at least two driving transistors for driving a micro light-emitting diode is provided in the embodiments of the present disclosure to realize a high dynamic range display, and a space in a pixel is saved at the same time due to one of the two driving transistors has an outer-drain-inner-source configuration and another of the two driving transistors has an outer-source-inner-drain configuration or a conventional channel with a stripe type configuration.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A micro light-emitting diode driving circuit, comprising:

a micro light-emitting diode;

a first driving transistor configured to receive a first driving voltage from a first driving voltage source, and being electrically connected to the micro light-emitting diode and a low voltage source, wherein a length of an edge of a channel of the first driving transistor in contact with a source terminal is shorter than a length of an edge of the channel of the first driving transistor in contact with a drain terminal; and a second driving transistor configured to receive a second driving voltage from a second driving voltage source, and being electrically connected to the micro light-emitting diode and the low voltage source, wherein a length of an edge of a channel of the second driving transistor in contact with a source terminal is greater than or equal to a length of an edge of the channel of the second driving transistor in contact with a drain terminal;

wherein one of the source and drain terminals of the first driving transistor and one of the source and drain terminals of the second driving transistor are electrically and separately connected to one end of the micro light-emitting diode, and a lateral length of the micro light-emitting diode is less than or equal to 50 μm.

2. The micro light-emitting diode driving circuit of claim 1, wherein the source terminal of the first driving transistor is surrounded by the drain terminal of the first driving transistor.

3. The micro light-emitting diode driving circuit of claim 1, wherein the drain terminal of the second driving transistor is surrounded by the source terminal of the second driving transistor.

4. The micro light-emitting diode driving circuit of claim 1, wherein the edge of the channel of the second driving transistor in contact with the source terminal and the edge of the channel of the second driving transistor in contact with the drain terminal are stripes and parallel to one another.

5. The micro light-emitting diode driving circuit of claim 1, further comprising:

a first storage capacitor having two ends, wherein one of the two ends of the first storage capacitor is connected to a gate terminal of the first driving transistor, and another of the two ends is connected to a source terminal of the first driving transistor or a first reference voltage; and a second storage capacitor having two ends, wherein one of the two ends of the second storage capacitor is connected to a gate terminal of the second driving transistor, and another of the two ends is connected to a source terminal of the second driving transistor or a second reference voltage.

6. The micro light-emitting diode driving circuit of claim 5, further comprising:

a first switching transistor having a gate terminal connected to a first scan line, a drain terminal connected to a first data line, and a source terminal connected to said one of the two ends of the first storage capacitor and the gate terminal of the first driving transistor; and a second switching transistor having a gate terminal connected to a second scan line, a drain terminal connected to a second data line, and a source terminal connected to said one of the two ends of the second storage capacitor and the gate terminal of the second driving transistor.

7. The micro light-emitting diode driving circuit of claim 6, wherein the first scan line and the second scan line are connected to a junction.

8. The micro light-emitting diode driving circuit of claim 7, wherein the first data line and the second data line are separated from each other.

9. The micro light-emitting diode driving circuit of claim 6, wherein the first scan line and the second scan line are separated from each other.

10. The micro light-emitting diode driving circuit of claim 9, wherein the first data line and the second data line are connected to a junction.

11. The micro light-emitting diode driving circuit of claim 9, wherein the first data line and the second data line are separated from each other.

12. The micro light-emitting diode driving circuit of claim 1, wherein the first driving voltage source and the second driving voltage source are the same driving voltage source.

13. The micro light-emitting diode driving circuit of claim 1, wherein the first driving voltage source and the second driving voltage source are separated from each other.

14. The micro light-emitting diode driving circuit of claim 1, wherein a ratio of a channel width to a channel length of the second driving transistor is greater than a ratio of a channel width to a channel length of the first driving transistor.

15. The micro light-emitting diode driving circuit of claim 14, wherein said ratio of the channel width to the channel length of the second driving transistor is at least twice greater than said ratio of the channel width to the channel length of the first driving transistor.

16. The micro light-emitting diode driving circuit of claim 1, wherein a ratio of a channel width to a channel length of the second driving transistor is the same as a ratio of a channel width to a channel length of the first driving transistor.

17. A micro light-emitting diode display, comprising:

a substrate; and a plurality of the micro light-emitting diode driving circuits of claim 1 present on the substrate.

* * * * *